US006634413B2

(12) United States Patent
Ray et al.

(10) Patent No.: US 6,634,413 B2
(45) Date of Patent: Oct. 21, 2003

(54) CENTRIFUGAL CASTING OF NICKEL BASE SUPERALLOYS IN ISOTROPIC GRAPHITE MOLDS UNDER VACUUM

(75) Inventors: Ranjan Ray, Phoenix, AZ (US); Donald W. Scott, Peoria, AZ (US)

(73) Assignee: Santoku America, Inc., Tollerson, AZ (US)

( * ) Notice: Subject to any disclaimer, the term of this patent is extended or adjusted under 35 U.S.C. 154(b) by 0 days.

(21) Appl. No.: 10/163,345

(22) Filed: Jun. 7, 2002

(65) Prior Publication Data

US 2003/0029593 A1 Feb. 13, 2003

Related U.S. Application Data

(60) Provisional application No. 60/296,770, filed on Jun. 11, 2001.

(51) Int. Cl.[7] ..... B22D 13/04

(52) U.S. Cl. ..... 164/114; 164/116; 164/117; 164/286; 164/289; 164/418; 164/459; 148/555; 427/228

(58) Field of Search ..... 164/114, 116, 164/117, 286, 289, 418, 459; 148/555; 427/228

(56) References Cited

U.S. PATENT DOCUMENTS

| | | | | |
|---|---|---|---|---|
| 2,977,222 A | | 3/1961 | Bieber | 172/823 |
| 3,241,200 A | | 3/1966 | Lirones | 164/517 |
| 3,243,733 A | | 3/1966 | Hosman | 333/106 |
| 3,256,574 A | | 6/1966 | Lirones | |
| 3,257,692 A | | 6/1966 | Operhall | 164/517 |
| 3,265,574 A | | 8/1966 | Scolari | 600/4 |
| 3,266,106 A | | 8/1966 | Lirones | 164/517 |
| 3,296,666 A | | 1/1967 | Lirones | 164/517 |
| 3,321,005 A | | 5/1967 | Lirones | 164/518 |
| 3,389,743 A | | 6/1968 | Morozov et al. | 164/516 |
| 3,485,288 A | | 12/1969 | Zusman et al. | 164/34 |
| 3,492,197 A | | 1/1970 | Olstowski et al. | 428/412 |
| 3,519,503 A | | 7/1970 | Moore et al. | 148/514 |
| 3,547,676 A | | 12/1970 | Bokros et al. | 427/213 |
| 3,567,896 A | | 3/1971 | Chang | 219/50 |
| 3,683,996 A | | 8/1972 | Dunlop | 164/14 |
| 3,718,720 A | * | 2/1973 | Lambdin, Jr. et al. | 264/29 |
| 3,781,158 A | * | 12/1973 | Leghorn | 164/459 |
| 3,900,540 A | | 8/1975 | Robba et al. | 264/29.6 |
| 4,005,163 A | | 1/1977 | Bokros | 264/81 |
| 4,129,462 A | | 12/1978 | Korenko | 148/31 |
| 4,209,348 A | | 6/1980 | Duhl et al. | 148/555 |
| 4,226,900 A | * | 10/1980 | Carlson et al. | 427/228 |

(List continued on next page.)

FOREIGN PATENT DOCUMENTS

| | | |
|---|---|---|
| JP | 55149747 | 11/1980 |
| JP | 60040644 | 3/1985 |
| SU | 1306641 | 4/1987 |

OTHER PUBLICATIONS

U.S. Ser. No. 10/143,920, Ranjan Ray et al., filed May 14, 2002.

U.S. Ser. No. 10/151,871, Ranjan Ray et al., filed May 22, 2002.

*Primary Examiner*—Tom Dunn
*Assistant Examiner*—I.-H. Lin
(74) *Attorney, Agent, or Firm*—Stevens, Davis, Miller & Mosher, LLP

(57) ABSTRACT

Methods for making various nickel based superalloys into engineering components such as rings, tubes and pipes by melting of the alloys in a vacuum or under a low partial pressure of inert gas and subsequent centrifugal casting of the melt in the graphite molds rotating along its own axis under vacuum or low partial pressure of inert gas are provided. The molds have been fabricated by machining high density, high strength ultrafine grained isotropic graphite, wherein the graphite has been made by isostatic pressing or vibrational molding.

12 Claims, 4 Drawing Sheets

U.S. PATENT DOCUMENTS 4,453,985 A 6/1984 Gessinger et al. ..... 148/501
4,574,015 A 3/1986 Genereux et al. ..... 148/677
4,579,602 A 4/1986 Paulonis et al. ..... 148/677
4,608,192 A 8/1986 Su ..... 252/506
4,612,062 A 9/1986 Nazmy et al. ..... 148/501
4,627,945 A 12/1986 Winkelbauer et al. ..... 264/29.5
4,670,201 A * 6/1987 Montgomery et al. ..... 264/26
4,719,080 A 1/1988 Duhl et al. ..... 420/443
4,761,272 A * 8/1988 Hucke ..... 423/445
4,769,087 A 9/1988 Genereux et al. ..... 148/677
5,026,521 A 6/1991 Kajimura et al. ..... 420/422
5,163,498 A 11/1992 Kantner et al. ..... 164/97
5,176,762 A 1/1993 Berczik ..... 148/407
5,226,946 A 7/1993 Diehm et al. ..... 75/10.14
5,489,411 A 2/1996 Jha et al. ..... 419/3
5,525,276 A 6/1996 Okuyama et al. ..... 264/29.3
5,630,465 A 5/1997 Feagin ..... 164/361
5,665,262 A 9/1997 Hajaligol et al. ..... 219/553
5,705,139 A 1/1998 Stiller et al. ..... 423/445 R
5,924,470 A 7/1999 Costilla-Vela et al. ..... 164/4.1
5,964,091 A * 10/1999 Fukui et al. ..... 60/752

* cited by examiner

CENTRIFUGAL CASTING OF NICKEL BASE SUPERALLOYS IN ISOTROPIC GRAPHITE MOLDS UNDER VACUUM

This application claims priority from U.S. Provisional Patent Application No. 60/296,770 filed on Jun. 11, 2001 incorporated herein by reference.

FIELD OF THE INVENTION

The invention relates to methods for making metallic alloys such as nickel base superalloys into hollow tubes, cylinders, pipes, rings and similar tubular products by melting the alloys in a vacuum or under a low partial pressure of inert gas and subsequently centrifugally casting the melt under vacuum or under a low pressure of inert gas in molds machined from fine grained high density, high strength isotropic graphite revolving around its own axis. The method also relates to a centrifugal casting mold apparatus that includes an isotropic graphite mold.

BACKGROUND OF THE INVENTION

Nickel base superalloys fabricated in shapes such as seamless rings, hollow tubes and pipes find many engineering applications in jet engines, oil and chemical industries and other high performance components. Complex highly alloyed nickel base superalloys are produced in seamless ring configurations for demanding applications in jet engines such as turbine casings, seals and rings. FIG. 1 shows a diagram of turbine casing 10 and a compressor casing 20. The turbine casing 10 is made of high temperature nickel base superalloys. Attached FIG. 2 also shows a diagram of a turbine casing 30 made of high temperature nickel base superalloys. Seamless rings can be flat (like a washer), or they can feature higher vertical walls (approximating a hollow cylindrical section). Heights of rolled rings range from less than an inch up to more than 9 ft. Depending on the equipment utilized, wall-thickness/height ratios of rings typically range from 1:16 up to 16:1, although greater proportions have been achieved with special processing.

The two primary processes for forging rings differ not only in equipment, but also in quantities produced. Also called ring forging, saddle-mandrel forging on a press is particularly applicable to heavy cross-sections and small quantities. Essentially, an upset and punched ring blank is positioned over a mandrel, supported at its ends by saddles. As the ring is rotated between each stroke, the press ram or upper die deforms the metal ring against the expanding mandrel, reducing the wall thickness and increasing the ring diameter.

In continuous ring rolling, seamless rings are produced by reducing the thickness of a pierced blank between a driven roll and an idling roll in specially designed equipment. Additional rolls (radial and axial) control the height and impart special contours to the cross-section. Ring rollers are well suited for, but not limited to, production of larger quantities, as well as contoured rings. In practice, ring rollers produce seamless rolled rings to closer tolerances or closer to finish dimensions. FIGS. 3A–3G show schematically the various steps of seamless rolled ring forging process operations. FIG. 4 shows a ring rolling machine in operation.

FIGS. 3A–3G show an embodiment of a seamless rolled ring forging process operation to make a ring 40. FIG. 3A shows the ring rolling process typically begins with upsetting of the starting stock 42 on flat dies 44 at its plastic deformation temperature—in the case of grade 1020 steel, approximately 2200 degrees Fahrenheit to make a relatively flatter stock 43. FIG. 3B shows that piercing the relatively flatter stock 43 involves forcing a punch 45 into the hot upset stock causing metal to be displaced radially, as shown by the illustration. FIG. 3C shows a subsequent operation, namely shearing with a shear punch 46, serves to remove a small punchout 43A to produce an annular stock 47. FIG. 3D shows that removing the small punchout 43A produces a completed hole through the annular stock 47, which is now ready for the ring rolling operation itself. At this point the annular stock 47 is called a preform 47. FIG. 3E shows the doughnut-shaped preform 47 is slipped over the ID (inner diameter) roll 48 shown from an "above" view. FIG. 3F shows a side view of the ring mill and preform 47 workpiece, which squeezes it against the OD (outer diameter) roll 49 that imparts rotary action. FIG. 3G shows that this rotary action results in a thinning of the section and corresponding increase in the diameter of the ring 40. Once off the ring mill, the ring 40 is then ready for secondary operations such as close tolerance sizing, parting, heat treatment and test/inspection.

FIG. 4 shows a photograph of a ring 40 roll forging machine in operation.

Even though basic shapes with rectangular cross-sections are common, rings featuring complex, functional cross-sections are produced by machining or forging from simple rings to meet virtually any design requirements. Aptly named, these "contoured" rolled rings can be produced in many different shapes with contours on the inside and/or outside diameters.

Production of superalloy rings from forging billets requires multiple steps by ring rolling. These alloys are difficult to hot work and can be hot deformed with small percentage of deformation in each step of ring roll forging. After each deformation operation, the outside and inside diameters of the stretched ring need to be ground to remove oxidized layers and forging cracks before reheating the ring for the next cycle of hot forging. Because of the extensive fabrication steps involved, the production costs are very high and yields are low. Typically, a 60 inch diameter ring weighing 250 lbs. suitable for application as a large jet engine casing is produce by ring roll forging of a starting billet weighing 2000 lbs. The high loss of expensive materials during fabrication steps results in high cost of the finished products.

The conventional route of tube making typically includes argon-oxygen decarburization (AOD) melting, continuous casting, hot rolling, boring, and extrusion. This route is mainly used for the high volume production of tubes up to 250 mm diameter. However, complex nickel base superalloys that are prone to macrosegregation are difficult or impossible to hot work.

Centrifugal casting complements the conventional tube making process and also offers considerable flexibility in terms of tube diameter and wall thickness. The mechanical properties of centrifugally cast tubes are often equivalent to conventionally cast and hot-worked material. The uniformity and density of centrifugal castings approaches that of wrought material, with the added advantage that the mechanical properties are nearly equal in all directions. Although many engineering ferrous and non-ferrous alloys which are amenable to processing by air melting and casting can be conveniently processed in tubes by centrifugal casting in air. However, complex nickel base superalloys require melting and casting in vacuum. Furthermore, during high speed rotation of the centrifugal mold lined with high purity ceramics, the highly reactive nickel base superalloy melts are likely to cause cracking and spalling of the ceramic liner leading to formation of very rough, outside surface of the cast tube. The ceramic liners spalling off the mold are likely to get trapped inside the solidified superalloy tube as detrimental inclusions that will significantly lower fracture toughness properties of the finished products.

There is a need for an improved cost effective process for making highly alloyed complex such as nickel based superalloys as tubes and seamless rings with simple or contoured cross sections which can be inexpensively machined into final shapes suitable for jet engine and other high performance engineering applications.

The term superalloy is used in this application in conventional sense and describes the class of alloys developed for use in high temperature environments and typically having a yield strength in excess of 100 ksi at 1000 degrees F. Nickel base superalloys are widely used in gas turbine engines and have evolved greatly over the last 50 years. As used herein the term superalloy will mean a nickel base superalloy containing a substantial amount of the γ' ($Ni_3Al$) strengthening phase, preferably from about 30 to about 50 volume percent of the γ' (gamma prime) phase. Representative of such class of alloys include the nickel base superalloys, many of which contain aluminum in an amount of at least about 5 weight % as well as one or more of other alloying elements, such as titanium, chromium, tungsten, tantalum, etc. and which are strengthened by solution heat treatment. Such nickel base superalloys are described in U.S. Pat. No. 4,209,348 to Duhl et al. and U.S. Pat. No. 4,719,080. Other nickel base superalloys are known to those skilled in the art and are described in the book entitled "Superalloys II" Sims et al., published by John Wiley & Sons, 1987.

Other references incorporated herein by reference in their entirety and related to superalloys and their processing are cited below:

"Investment-cast superalloys challenge wrought materials" from Advanced Materials and Process, No. 4, pp. 107–108 (1990).

"Solidification Processing", editors B. J. Clark and M. Gardner, pp. 154–157 and 172–174, McGraw-Hill (1974).

"Phase Transformations in Metals and Alloys", D. A. Porter, p. 234, Van Nostrand Reinhold (1981).

Nazmy et al., The effect of advanced fine grain casting technology on the static and cyclic properties of IN713LC. Conf: High temperature materials for power engineering 1990, pp. 1397–1404, Kluwer Academic Publishers (1990).

Bouse & Behrendt, Mechanical properties of Microcast-X alloy 718 fine grain investment castings, Conf: Superalloy 718: Metallurgy and applications, Publ:TMS pp. 319–328 (1989).

Abstract of U.S.S.R. Inventor's Certificate 1306641 Published Apr. 30, 1987.

WPI Accession No. 85-090592/85 & Abstract of JP 60-40644 (KAWASAKI) Published Mar. 4, 1985.

WPI Accession No. 81-06485D/81 & Abstract of JP 55-149747 (SOGO) Published Nov. 21, 1980.

Fang, J: Yu, B Conference: High Temperature Alloys for Gas Turbines, 1982, Liege, Belgium, Oct. 4–6, 1982, pp. 987–997, Publ: D. Reidel Publishing Co., P.O. Box 17, 3300 AA Dordrecht, The Netherlands (1982).

Processing techniques for superalloys have also evolved as evident from the following references incorporated herein by reference in their entirety, and many of the newer processes are quite costly.

U.S. Pat. No. 3,519,503 describes an isothermal forging process for producing complex superalloy shapes. This process is currently widely used, and as currently practiced requires that the starting material be produced by powder metallurgy techniques. The reliance on powder metallurgy techniques makes this process expensive.

U.S. Pat. No. 4,574,015 deals with a method for improving the forgeability of superalloys by producing overaged microstructures in such alloys. The gamma prime phase particle size is greatly increased over that which would normally be observed.

U.S. Pat. No. 4,579,602 deals with a superalloy forging sequence which involves an overage heat treatment.

U.S. Pat. No. 4,769,087 describes another forging sequence for superalloys.

U.S. Pat. No. 4,612,062 describes a forging sequence for producing a fine grained article from a nickel base superalloy.

U.S. Pat. No. 4,453,985 describes an isothermal forging process which produces a fine grain product.

U.S. Pat. No. 2,977,222 incorporated herein by reference describes a class of superalloys similar to those to which the invention process has particular applicability.

It is well known to make a metal shape by a centrifugal casting process in which molten metal is poured into a hollow mould which is rotating. Centrifugal casting provides the advantage of achieving segregation of impurities towards the axis of rotation and away from the external surface of the casting since impurities generally encountered are of lower density than the metal of the casting. Moreover, centrifugal casting enables the production of hollow cast shapes of controlled wall thickness without the need for central cores although, if desired, the rotating mould can be filled sufficiently so as to provide a shape without a central cavity. In either case the part of the casting containing the impurities can be removed, for example by machining.

Hitherto such centrifugal casting has been used with permanent moulds for metal shapes of relatively simple external surface configuration such as generally cylindrical. By providing a sand mould of appropriate shape within a container, generally made of steel, the external surface of the casting may be provided with a more complex configuration, within constraints imposed by the difficulty, complexity and expense of removing rigid patterns, typically of wood, for producing the sand mould, even when the rigid patterns are made collapsible to facilitate removal.

There is a demand for metal shapes, particularly hollow shapes such as gas turbine engine casings, having an external shape of relatively high complexity and precision than it has hitherto been possible, or economically possible, to manufacture by centrifugal casting.

U.S. Pat. No. 6,116,327 to Beighton incorporated herein by reference discloses a method of making a metal shape comprising the steps of supplying molten metal into a ceramic shell mould mounted in a container, spinning the container and the shell mould therein about an axis and permitting the metal to solidify in the shell mould and thereafter removing, for example by breaking, the shell mould to expose the metal shape. The ceramic shell moulds made by providing a pattern of flexible elastically deformable material of a required shape and supported on a mandrel, applying at least one coating of hardenable refractory material to said pattern to form a rigid shell and removing the mandrel from supporting relationship with the pattern and subsequently removing the pattern from the shell by elastically deforming the pattern. The pattern is made by molding the material in a master mold of a required shape and removing the pattern from the master mold, after the pattern has set, by elastically deforming the pattern.

U.S. Pat. No. 5,826,322 Hugo, et al. incorporated herein by reference discloses the production of particles from castings (10) of metals from the group of the lanthanides, aluminum, boron, chromium, iron, calcium, magnesium, manganese, nickel, niobium, cobalt, titanium, vanadium, zirconium, and their alloys, which have solidified in an oriented manner, especially for the production of materials from the group of magnetic materials, hydrogen storage elements (hydride storage elements), and battery electrodes, a melt of the metal is applied in a nonreactive atmosphere to the inside of an at least essentially cylindrical cooling surface (9) according to the principle of centrifugal casting. The cylinder rotates at high speed around a rotational axis, and the melt is cooled proceeding from the outside toward the inside with an essentially radial direction of solidification. The hollow casting (10) is then reduced to particles. The melt is preferably applied to the rotating cooling surface (9) in a thickness which is no more than 10%, and preferably no more than 5%, of the diameter of the cooling surface (9), and the diameter of the cooling surface (9) is at least 200 mm, and preferably at least 500 mm.

The use of graphite in investment molds has been described in U.S. Pat. Nos. 3,241,200; 3,243,733; 3,265,574; 3,266,106; 3,296,666 and 3,321,005 all to Lirones and all incorporated herein by reference. U.S. Pat. Nos. 3,257,692 to Operhall; 3,485,288 to Zusman et al.; and 3,389,743 to Morozov et al. disclose carbonaceous mold surface utilizing graphite powders and finely divided inorganic powders termed "stuccos" and are incorporated herein by reference.

U.S. Pat. No. 4,627,945 to Winkelbauer et al., incorporated herein by reference, discloses injection molding refractory shroud tubes made from alumina and from 1 to 30 weight percent calcined fluidized bed coke, as well as other ingredients. The '945 patent also discloses that it is known to make isostatically-pressed refractory shroud tubes from a mixture of alumina and from 15 to 30 weight percent flake graphite, as well as other ingredients.

PREFERRED OBJECTS OF THE PRESENT INVENTION

It is an object of the invention to centrifugally cast nickel base superalloys as tubes, pipes and rings under vacuum or partial pressure of inert gas in isotropic graphite molds rotating around its own axis.

It is another object of the present invention to provide a centrifugal casting apparatus which includes an isotropic graphite mold.

SUMMARY OF THE INVENTION

This invention relates to a process for making various metallic alloys such as nickel based superalloys as engineering components such as rings, tubular parts and pipes by vacuum induction melting of the alloys and subsequent centrifugal casting of the melt in graphite molds rotating around its own axis under vacuum. More particularly, this invention relates to the use of high density, high strength isotropic graphite. FIG. 5 shows a schematic drawing of the centrifugal vacuum casting equipment for casting nickel base superalloys in a rotating isotropic graphite mold under vacuum to make a hollow tube casting in accordance with the scope of the present invention.

From a vessel in a vacuum chamber, molten metal is poured through a launder into a rotating isotropic graphite mold. With centrifugal casting, the rotating isotropic graphite metal mold revolves under vacuum at high speeds in a horizontal, vertical or inclined position as the molten metal is being poured. The axis of rotation may be horizontal or inclined at any angle up to the vertical position. Molten metal, poured into the spinning mold cavity, is held against the wall of the mold by centrifugal force. The speed of rotation and metal pouring rate vary with the alloy and size and shape being cast.

As the molten metal alloy is poured into the rotating isotropic graphite mold, it is accelerated to mold speed. Centrifugal force causes the metal to spread over and cover the mold surface. Continued pouring of the molten metal increases the thickness to the intended cast dimensions. Rotational speeds vary but sometimes reach more than 150 times the force of gravity on the outside surface of the castings.

Once the metal is distributed over the mold surface, solidification begins immediately. Metal feeds the solid-liquid interface as it progresses toward the bore. This, combined with the centrifugal pressure being applied, results in a sound, dense structure across the wall with impurities generally being confined near the inside surface. The inside layer of the solidified part can be removed by boring if an internal machined surface is required. Accordingly, the hollow tube casting is solidified and recovered.

For specialized engineered shapes, centrifugal casting offers the following distinct benefits of nickel base superalloys:

- any superalloy common to static pouring under vacuum can be centrifugally cast in accordance with the present invention as a tubular product, ring and pipe; and
- mechanical properties of centrifugally cast nickel base superalloys according to the present invention will be excellent.

Centrifugal castings of nickel base superalloy can be made in almost any required length, thickness and diameter. Because the mold forms only the outside surface and length, castings of many different wall thicknesses can be produced from the same size mold. The centrifugal force of this process keeps the casting hollow, eliminating the need for cores.

Horizontal centrifugal casting technique is suitable for the production of superalloy pipe and tubing of long lengths. The length and outside diameter are fixed by the mold cavity dimensions while the inside diameter is determined by the amount of molten metal poured into the mold.

Castings other than cylinders and tubes also can be produced in vertical casting machines. Castings such as controllable pitch propeller hubs, for example, can be made using this variation of the centrifugal casting process.

The outside surface of the casting or the mold surface proper can be modified from the true circular shape by the introduction of flanges or small bosses, but they must be generally symmetrical about the axis to maintain balance. The inside surface of a true centrifugal casting is always cylindrical. In semi-centrifugal casting, a central core is used to allow for shapes other than a true cylinder to be produced on the inside surface of the casting.

The uniformity and density of centrifugal castings approaches that of wrought material, with the added advantage that the mechanical properties are nearly equal in all directions. Most alloys can be cast successfully by the centrifugal process, once the fundamentals have been mastered. Since no gates and risers are used, the yield or ratio of casting weight-to-weight of metal is high.

High tangential strength and ductility will make centrifugally cast nickel base superalloys well-suited for torque- and pressure-resistant components, such as gears, engine bearings for aircraft, wheel bearings, couplings, rotor spacers, sealed discs and cases, flanges, pressure vessels and valve bodies.

Superalloy melts do not react with high density, ultra fine grained isotropic graphite molds and hence, the molds can be used repeatedly many times thereby reducing significantly the cost of fabrication of centrifugally cast superalloy components compared to traditional process. Near net shape parts can be cast, eliminating subsequent operating steps such as machining.

DETAILED DESCRIPTION OF THE PREFERRED EMBODIMENTS

A. Graphite

Figure 1:
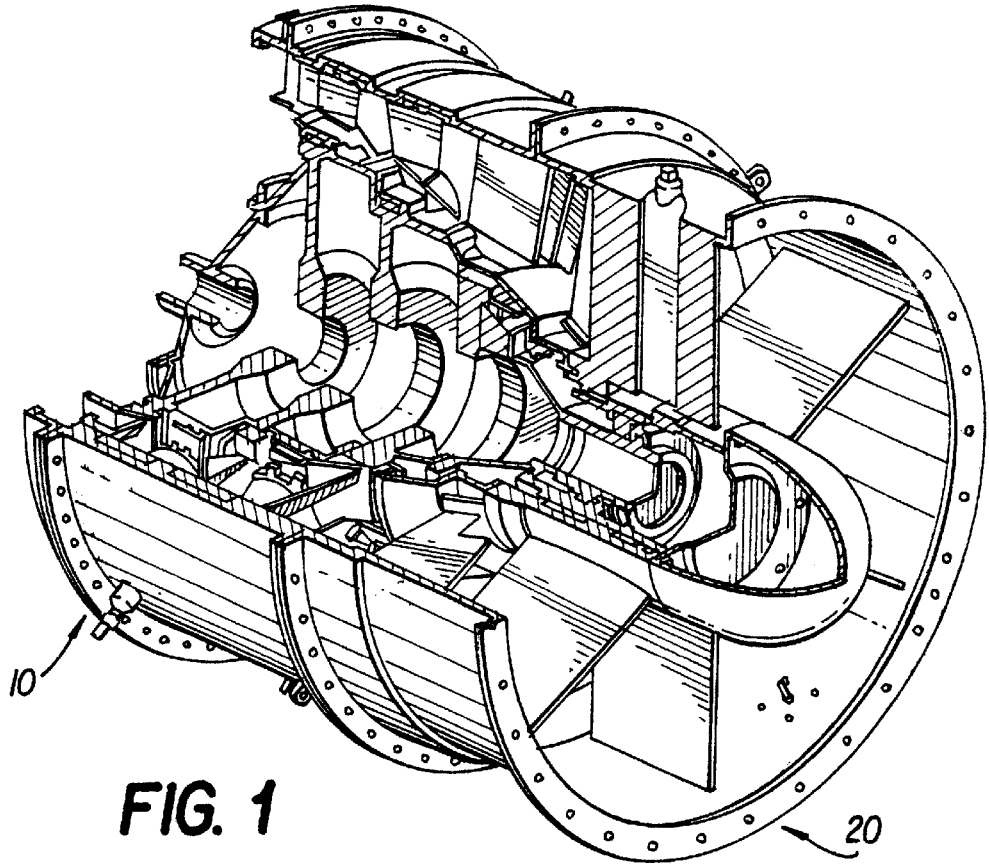
FIG. 1 shows a turbine casing and compressor casing.
Figure 2:
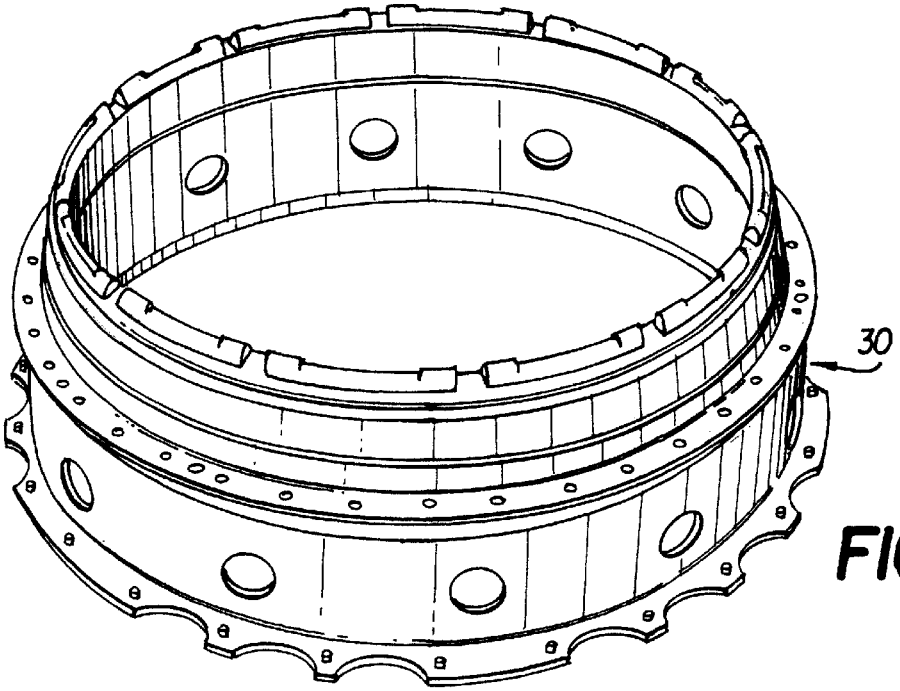
FIG. 2 shows a gas turbine engine casing.
Figure 3A:
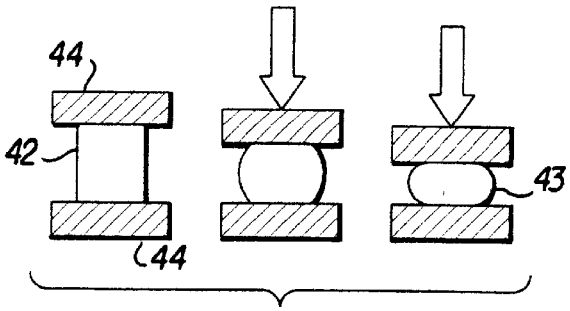
FIGS. 3A–3G show an embodiment of a seamless rolled ring forging process operation.
Figure 3B:
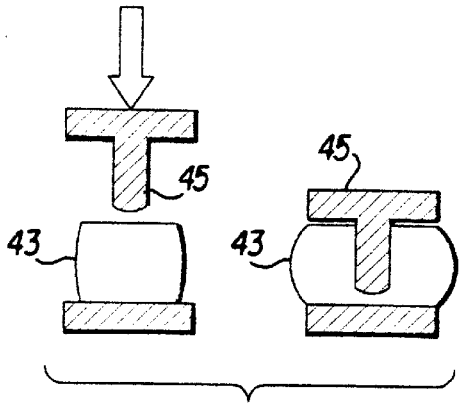
Figure 3C:
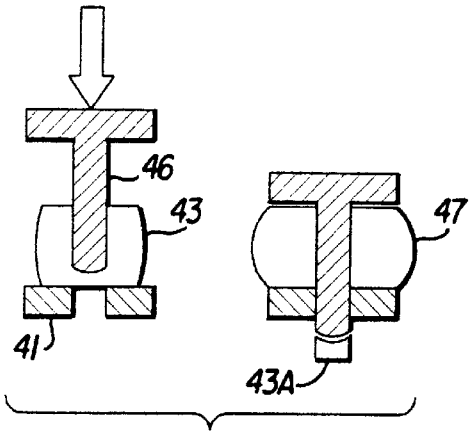
Figure 3D:
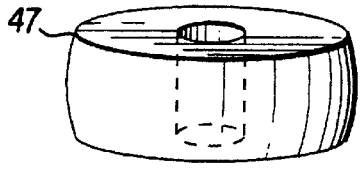
Figure 3E:
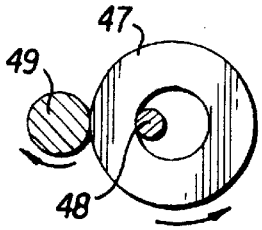
Figure 3F:
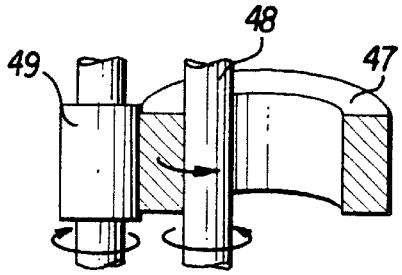
Figure 3G:
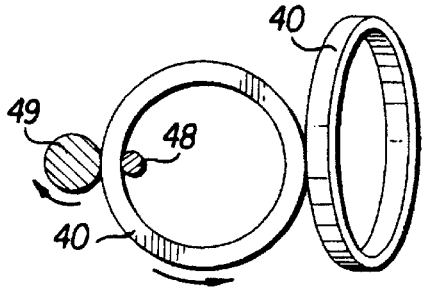
Figure 4:
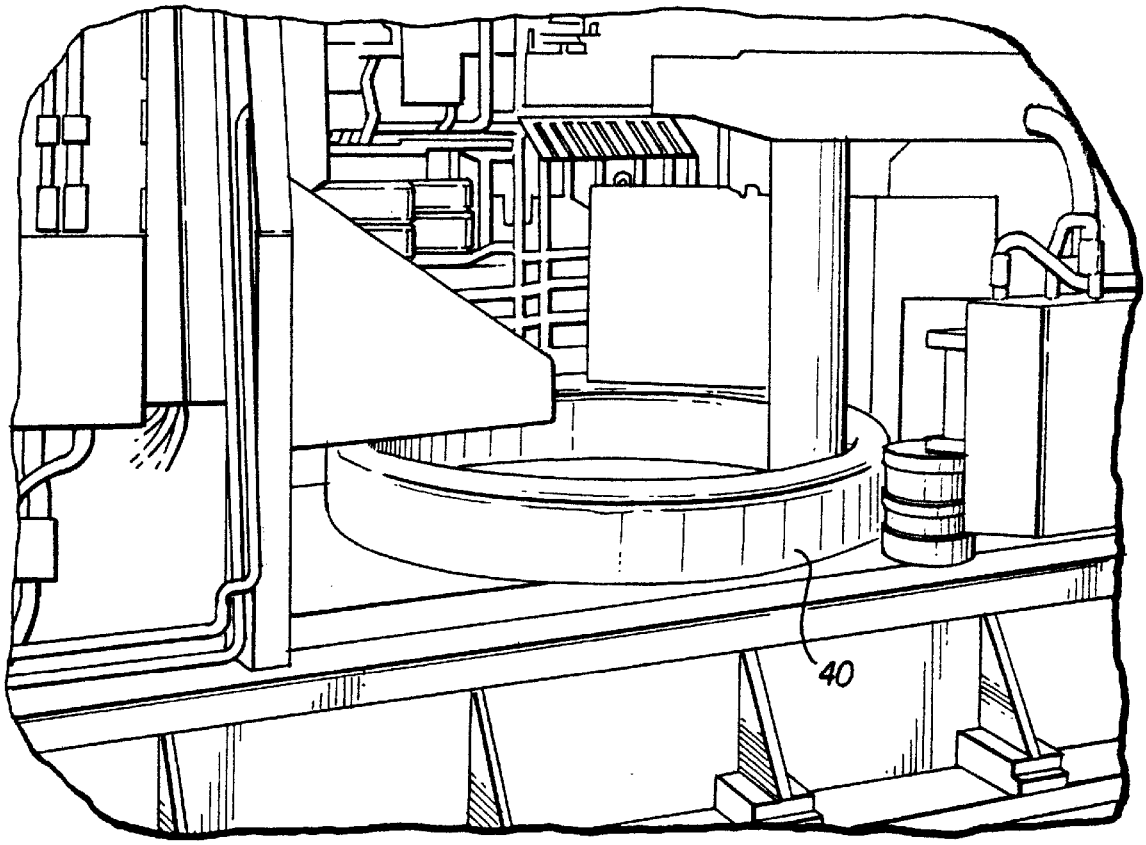
FIG. 4 is a depiction of a ring roll forming machine in operation.

Isotropic graphite is preferred as material for the main body of the mold of the present invention for the following reason:

Isotropic graphite made via isostatic pressing has fine grains (about 3 to 40 microns) whereas extruded graphite is produced from relative coarse carbon particles resulting into coarse grains (400–1200 microns). Isotropic fine grained graphite has much higher strength, and structural integrity than other grades of graphite, such as those made by extrusion process, due to the presence of fine grains, higher density and lower porosity as well as the absence of "loosely bonded" carbon particles.

Isotropic fine grained graphite can be machined with a very smooth surface compared to extruded graphite due to its high hardness, fine grains and low porosity. More particularly, this invention relates to the use of high density, ultrafine grained isotropic graphite molds, the graphite of very high purity (containing negligible trace elements) being made via the isostatic pressing route. High density (from 1.65 to 1.9 gm/cc, generally 1.77 to 1.9 gm/cc), small porosity (<about 15%, generally <about 13%), high flexural strength (between 5,500 and 20,000 psi, generally 7,000 to 20,000 psi), high compressive strength (>9,000 psi, generally between 12,000 and 35,000 psi, more preferably between 17,000 and 35,000 psi) and fine grains (typically about 3 to 40 microns, preferably about 3 to 10 micron) are some of the characteristics of isostatically pressed graphite that render it suitable for use as molds for centrifugal casting superalloys. Other advantages of the graphite material are high thermal shock, wear and chemical resistance, and minimum wetting by liquid metal.

References relating to isotropic graphite include U.S. Pat. Nos. 4,226,900 to Carlson, et al, 5,525,276 to Okuyama et al, and 5,705,139 to Stiller, et al., all incorporated herein by reference.

Isotropic fine grained graphite is synthetic material produced by the following steps:

(1) Fine grained coke extracted from mines is pulverized, separated from ashes and purified by flotation techniques. The crushed coke is mixed with binders (tar) and homogenized.

(2) The mixture is isostatically pressed into green compacts at room temperature (3) The green compacts are baked at 1200° C. causing carbonizing and densification. The binder is converted into carbon. The baking process binds the original carbon particles together (similar to the process of sintering of metal powders) into a solid mass.

(4) The densified carbon part is then graphitized at 2600° C. Graphitization is the formation of ordered graphite lattice from carbon. The carbon from the binder around the grain boundaries is also converted into graphite. The final product is nearly 100% graphite (the carbon from the binder is all converted in graphite during graphitization)

Extruded anisotropic graphite is synthesized according to the following steps;

(1) Coarse grain coke (pulverized and purified) is mixed with pitch and warm extruded into green compacts.

(2) The green compacts are baked at 1200° C. (carbonization and densification). The binder (pitch is carbonized).

(3) The baked compact is graphitized into products that are highly porous and structurally weak. It is impregnated with pitch to fill the pores and improve the strength.

(4) The impregnated graphite is baked again at 1200 C. to carbonize the pitch. (5) The final product (extruded graphite) contains ~90–95% graphite and ~5–10% loosely bonded carbon.

The typical physical properties of isotropic graphite made via isostatic pressing and anisotropic graphite made via extrusion are given in TABLES 1 and 2.

TABLE 1

(PROPERTIES OF ISOTROPIC GRAPHITE MADE VIA ISOSTATIC PRESSING)

| Grade | Density (gm/cc) | Shore Hardness | Flexural Strength (psi) | Compressive Strength (psi) | Grain Size (microns) | Thermal Conductivity BTU/ft-hr-° F. | Porosity (open) |
|---|---|---|---|---|---|---|---|
| R 8500 | 1.77 | 65 | 7250 | 17,400 | 6 | 46 | 13% |
| R 8650 | 1.84 | 75 | 9400 | 21750 | 5 | 52 | 12% |
| R 8710 | 1.88 | 80 | 12300 | 34800 | 3 | 58 | 10% |

TABLE 2

(PROPERTIES OF ANISOTROPIC GRAPHITE MADE VIA EXTRUSION)

| Grade | Density (gm/cc) | Rockwell "R" Hardness | Flexural Strength (psi) | Compressive Strength (psi) | Grain Size (microns) | Thermal Conductivity BTU/ft-hr-° F. | Porosity (open) |
|---|---|---|---|---|---|---|---|
| HLM | 1.72 | 87 | 3500 | 7500 | 410 | 86 | 23% |
| HLR | 1.64 | 58 | 1750 | 4500 | 760 | 85 | 27% |

Parameters referenced in the present specification are measured according to the following standards unless otherwise indicated.

Compressive strength is measured by ASTM C-695.

Flexural strength is measured by ASTM C 651.

Thermal conductivity is measured according to ASTM C-714.

Porosity is measured according to ASTM C-830.

Shear strength is measured according to ASTM C273, D732.

Shore hardness is measured according to ASTM D2240.

Grain size is measured according to ASTM E 112.

Coefficient of thermal expansion is measured according to E 831.

Density is measured according to ASTM C838-96.

Oxidation threshold is measured according ASTM E 1269-90.

Vickers microhardness in HV units is measured according to ASTM E 384.

Isotropic graphite produced by isostatic pressing or vibration molding has fine isotropic grains (3–40 microns) whereas graphite produced via extrusion from relative coarse carbon particles have into coarse anisotropic grains (400–1200 microns).

Isotropic graphite has much higher strength and higher structural integrity than extruded anisotropic graphite due to the above-described absence of "loosely bonded" carbon particles, finer grains, higher density and lower porosity.

When liquid metal is poured into the extruded graphite molds, the mold wall/melt interface is subjected to shear and compressive stresses which cause fracture of graphite at the interface. The graphite particles and "loosely bonded carbon mass" plucked away from the mold wall are absorbed into the hot melt and begin to react with oxide particles in the melt and generate carbon dioxide gas bubbles. These gas bubbles coalesce and get trapped as porosity into the solidified castings.

Due to high intrinsic strength and absence of "loosely bonded" carbon mass, isostatic graphite will resist erosion and fracture due to shearing action of the liquid metal better than extruded graphite and hence castings made in isostatic graphite molds show less casting defects and porosity compared to the castings made in extruded graphite.

Additional information about isotropic graphite is disclosed in U.S. patent application Ser. No. 10/143,920, filed May 14, 2002, incorporated herein by reference in its entirety.

B. Alloys

There are a variety of nickel base superalloys.

Nickel base superalloys contain 10–20% Cr, at most about 8% total Al and/or Ti, and one or more elements in small amounts (0.1–12% total) such as B, C and/or Zr, as well as small amounts (0.1–12% total) of one or more alloying elements such as Mo, Nb, W, Ta, Co, Re, Hf, and Fe. There may also several trace elements such as Mn, Si, P, S, O and N that must be controlled through good melting practices. There may also be inevitable impurity elements, wherein the impurity elements are less than 0.05% each and less than 0.15% total. Unless otherwise specified, all % compositions in the present description are weight percents.

C. The Mold

Typically a block of isotropic graphite is made as described above and then a mold cavity is machined into the block to form the isotropic graphite mold. If desired, the isotropic graphite can be initially pressed during formation to have a mold cavity.

Figure 5:
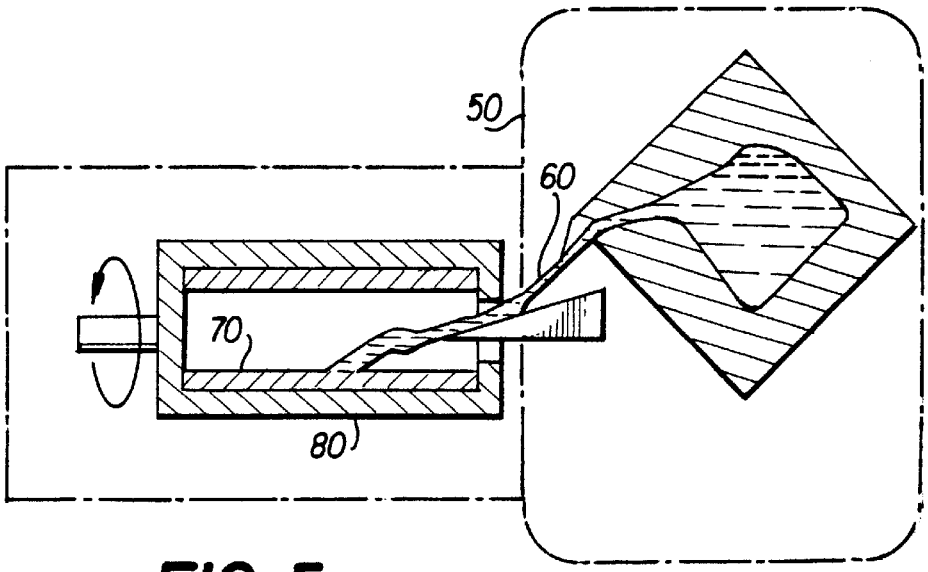
FIG. 5 is a schematic of a centrifugal casting apparatus according to the present invention.
Figure 6:
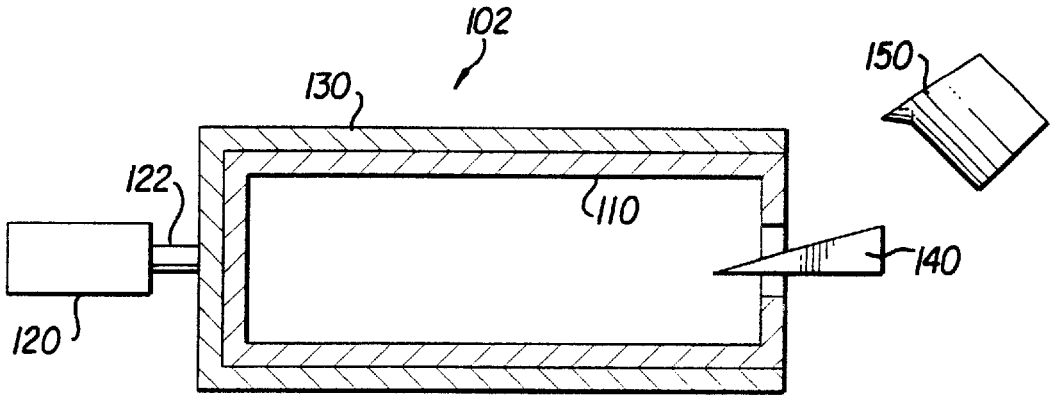
FIG. 6 is a schematic drawing of a cross-section of the centrifugal casting apparatus according to the present invention which further shows a motor for spinning the mold.

FIGS. 5 and 6 schematically show an embodiment of a rotatable centrifugal mold of the present invention for molding a hollow tube casting 70, 110, respectively.

FIG. 5 shows a schematic drawing of the centrifugal vacuum casting equipment for casting nickel base superalloys in a rotating isotropic graphite mold under vacuum to make a hollow tube casting 70 in accordance with the scope of the present invention.

From a vessel in a vacuum chamber 50, molten metal 60 is poured through a launder into a rotating isotropic graphite mold 80. With centrifugal casting, the rotating isotropic graphite metal mold 80 revolves under vacuum at high speeds in a horizontal, vertical or inclined position as the molten metal 60 is being poured. The axis of rotation may be horizontal or inclined at any angle up to the vertical position. Molten metal 60, poured into the spinning mold cavity, is held against the wall of the mold 80 by centrifugal force. The speed of rotation and metal pouring rate vary with the alloy and size and shape being cast.

As the molten metal alloy 60 is poured into the rotating isotropic graphite mold 80, it is accelerated to mold speed. Centrifugal force causes the metal to spread over and cover the mold surface. Continued pouring of the molten metal 60 increases the thickness to the intended cast dimensions. Rotational speeds vary but sometimes reach more than 150 times the force of gravity on the outside surface of the castings.

Once the metal 60 is distributed over the mold surface, solidification begins immediately. Metal feeds the solid-liquid interface as it progresses toward the bore. This, combined with the centrifugal pressure being applied, results in a sound, dense structure across the wall with impurities generally being confined near the inside surface. The inside layer of the solidified part can be removed by boring if an internal machined surface is required. Accordingly, the hollow tube casting 70 is solidified and recovered.

Figure 7:
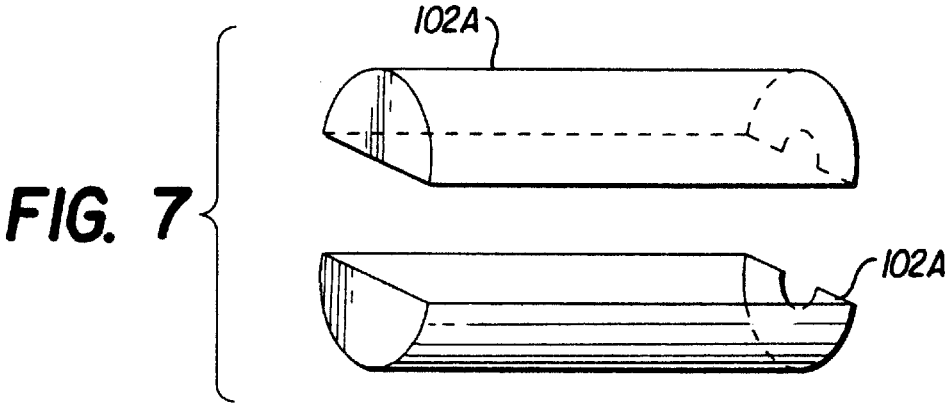
FIG. 7 shows the mold as two longitudinally split pieces.
Figure 8:
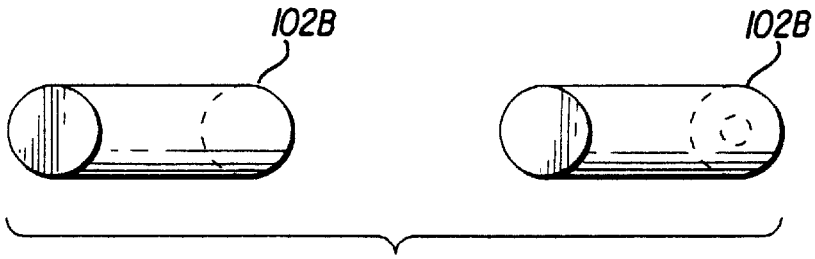
FIG. 8 shows the mold as two transversely split pieces.

FIG. 6 shows a mold 102 including a hollow isotropic graphite cylinder 110 within a holder 30. The holder 130 is attached to a shaft 122 of a motor 120. Molten metal (shown in FIG. 5, but not shown in FIG. 6) would be discharged from a vessel 150 through a launder 140 into the cavity of the isotropic graphite cylinder 110. The cylinder is attached to the base 130 attached to the shaft 122. The motor 120 turns the shaft to turn the cylinder 110 at a speed sufficient for centrifugal casting. In other words, sufficient to drive the melt to a consistent thickness along the inner longitudinal walls of the cylinder 110 while the melt cools and solidifies. The mold is conveniently made of two parts. During spinning the two parts are held together by the holder 130 and/or other appropriate means, e.g., bracing not shown. After the melt solidifies, the cylinder 110 is opened and the metal tube product is removed. For example, the mold 110 may be made of two longitudinally split parts as shown in FIG. 7 or may be made of two transversely split parts as shown in FIG. 8. Thus, the graphite cylinder 110 is reuseable.

D. Use of the Mold

Centrifugal castings are produced by pouring molten metal into the graphite mold and rotating or revolving the mold around its own axis during the casting operation.

An alloy is melted by any conventional process that achieves uniform melting and does not oxidize or otherwise harm the alloy. For example, a preferred heating method is vacuum induction melting. Vacuum induction melting is a known alloy melting process as described in the following references: D. P. Moon et al, ASTM Data Series DS 7-SI, 1-350 (1953); M. C. Hebeisen et al, NASA SP-5095, 31–42 (1971); and R. Schlatter, "Vacuum Induction Melting Technology of High Temperature Alloys" Proceedings of the AIME Electric Furnace Conference, Toronto, 1971.

Examples of other suitable heating processes include "plasma vacuum arc remelting" technique and induction skull melting.

The candidate nickel base superalloys are melted in vacuum by a melting technique and the liquid metal is poured under full or partial vacuum into the heated or unheated graphite mold. In some instances of partial vacuum, the liquid metal is poured under a partial pressure of inert gas.

The molding then occurs under full or partial vacuum. During casting (molding) the mold is subjected to centrifuging. As a consequence of the centrifuging action, molten alloy poured into the mold will be forced from a central axis of the equipment into individual mold cavities that are placed on the circumference. This provides a means of increasing the filling pressure within each mold and allows for reproduction of intricate details.

Thus, tubular products of alloys may be produced based on vacuum centrifugal casting of the selected alloys in a molten state in an isotropic graphite mold, wherein the mold is rotated about its own axis.

The axis of rotation may be horizontal or inclined at any angle up to the vertical position. Molten metal is poured into the spinning mold cavity and the metal is held against the wall of the mold by centrifugal force. The speed of rotation and metal pouring rate vary with the alloy and size and shape being cast. During molding the mold typically rotates at 10 to 3000 revolutions per minute. Rotation speed may be used to control the cooling rate of the metal.

The inside surface of a true centrifugal casting is cylindrical. In semi-centrifugal casting, a central core is used to allow for shapes other than a true cylinder to be produced on the inside surface of the casting. Centrifugal casting of the present invention encompasses true centrifugal casting and/or semi-centrifugal casting.

The uniformity and density of centrifugal castings are expected to approach that of wrought material, with the added advantage that the mechanical properties are nearly equal in all directions. Directional solidification from the outside surface contacting the mold will result in castings of exceptional quality free from casting defects.

High purity and high density of the isotropic graphite mold material of the present invention enhances non-reactivity of the mold surface with respect to the liquid melt during solidification. As a consequence, the process of the present invention produces a casting having a very smooth high quality surface as compared to the conventional ceramic mold casting process. The isotropic graphite molds show very little reaction with molten nickel base superalloys and suffer minimal wear and erosion after use and hence, can be used repeatedly over many times to fabricate centrifugal castings of the said alloys with high quality. Whereas the conventional ceramic molds are used one time for fabrication of superalloy castings.

Furthermore, the fine grain structures of the castings resulting from the fast cooling rates experienced by the melt will lead to improved mechanical properties such as high strength for many nickel base superalloys suitable for applications as jet engine components.

The uniformity and density of centrifugal castings is expected to approach that of wrought material, with the added advantage that the mechanical properties are nearly equal in all directions. Directional solidification from the outside surface contacting the mold will result in castings of exceptional quality free from casting defects.

EXAMPLE 1

Various nickel, cobalt and iron base superalloys that are suitable candidates to be fabricated by the centrifugal casting technique as components with high integrity and quality under vacuum in isostatic graphite molds are given in TABLE 3.

TABLE 3

(compositions are in weight %)

| Alloy | Ni | Cr | Co | Mo | W | Fe | C | Ta + Nb | Al | Ti | Si | Others |
|---|---|---|---|---|---|---|---|---|---|---|---|---|
| IN738 | 63 | 16 | 8.5 | 1.75 | 2.6 | 0.5 | 0.13 | 2.6 | 3.45 | 3.45 | 0.2 | 0.1 Hf |
| Rene 80 | 60.5 | 14 | 9.5 | 4.0 | 4.0 | 0.17 | | 3.0 | 5.0 | | | 0.03 Zr 0.15 B |
| Mar-M247 | 60 | 8.25 | 10 | 0.7 | 10 | | 0.15 | 3.0 | 5.5 | 1.0 | | 1.5 Hf 0.15 B 0.05 Zr |
| PWA 795 | 14.03 | 19.96 | 46.4 | | 9.33 | | 0.35 | 2.89 | 4.4 | 0.18 | 0.17 | 1.14 Hf 0.02 Zr 0.07 Y |
| Rene 142 | 57.4 | 6.89 | 11.90 | 1.47 | 5.03 | | 0.12 | 6.46 | 6.25 | 0.005 | 0.012 | 2.76 Re 1.54 Hf 0.017 Zr 0.018 B |
| Mar-M200 | 59 | 9.0 | 10.0 | | 12.5 | 1.5 | 0.15 | 1.0 | 5.0 | 2.0 | | 0.015 B 0.05 Zr |
| FSX 414 | 10 | 29 | 53.08 | | 7.0 | | 0.12 | | | | 0.8 | |
| IN939 | 48.33 | 22.5 | 19 | | 2.0 | | 0.16 | 1.35 | 1.85 | 3.8 | | 0.005 B 0.01 Nb |
| IN792 | 61 | 12.5 | 9.0 | 1.9 | 4.15 | 0.5 | 0.1 | 4.65 | 3.35 | 3.95 | 0.2 | |
| Mar-M918 | 19 | 19 | 54.56 | | | 0.5 | 0.04 | 7.0 Ta | | | | |
| Mar-M509 | 10 | 23.5 | 55 | | 7.0 | | 0.60 | 3.5 | | 0.2 | | 0.5 Zr |
| Alloy 1957 | 69.9 | 21.67 | 0.009 | | | | 0.012 | 2.63 | | 0.57 | 0.43 | 1.98 Pd |
| Pmet 920 | 43.45 | 20 | 13.5 | 1.5 | 15.50 | | 0.045 | 4.2 Ta | 0.80 | | 0.40 | 0.60 Mn |
| Alloy 1896 | 60.23 | 14 | 9.5 | 1.55 | 3.8 | 0.10 | | 2.8 Ta | 3.0 | 4.9 | | 0.035 Zr 0.005 B |
| 501SS | | 7.0 | | 0.55 | | 92.33 | 0.12 | | | | | |
| SS316-GD | 11.65 | 16.33 | 2.2 | | 66.65 | | | | | | 0.1 | 0.4 Gd 1.7 Mn |

Typical shapes of superalloy castings that can be fabricated by the method described in the present invention are as follows:

(1) Rings and hollow tubes and the like with typical dimensions as follows: 4 to 80 inch diameter×0.25 to 4 inch wall thickness×1 to 120 inches long.

(2) The molds can be machined to produce contoured profiles on the outside diameter of the centrifugally cast superalloy tubular products and rings.

(3) The molds can be machined with a taper so that the castings with desired taper can be directly cast according to specific designs.

It should be apparent that in addition to the above-described embodiments, other embodiments other embodiments are also encompassed by the spirit and scope of the present invention. Thus, the present invention is not limited by the above-provided description, but rather is defined by the claims appended hereto.

What is claimed is:

1. A method of making cast shapes such as rings, tubes and pipes with smooth or contoured profiles on the outside diameter of nickel base superalloys, comprising the steps of:

melting the alloy under vacuum or partial pressure of inert gas;

pouring the alloy into a cylindrical mold rotating around its own axis, wherein the mold is made of machined graphite, wherein the graphite has been isostatically or vibrationally molded and has ultra fine isotropic grains between 3–40 micron, a density between 1.65 and 1.9 grams/cc, flexural strength between 5,500 and 20,000 psi, compressive strength between 9,000 and 35,000 psi, and porosity below 15%; and solidifying the melted alloy into a solid body taking the shape of the mold cavity.

2. The method of claim 1, wherein the metallic alloy is selected from the group consisting of nickel base superalloy, nickel-iron base superalloy and cobalt base superalloy.

3. The method of claim 1, wherein the metallic alloy is a nickel base superalloy containing 10–20% Cr, at most about 8% total of one or more elements selected from the group consisting of Al and Ti, 0.1–12% total of one or more elements selected from the group consisting of B, C and/or Zr, and 0.1–12% total of one or more alloying elements such as Mo, Nb, W, Ta, Co, Re, Hf, and Fe, and inevitable impurity elements, wherein the impurity elements are less than 0.05% each and less than 0.15% total.

4. The method of claim 1, wherein the alloy is melted by a method selected from the group consisting of vacuum induction melting and plasma arc remelting.

5. The method of claim 1, wherein the mold has been isostatically molded.

6. The method of claim 1, wherein the graphite of the mold has isotropic grains with grain size between 3 and 10 microns, and the mold has flexural strength greater than 7,000 psi, compressive strength between 12,000 and 35,000 psi, and porosity below 13%.

7. The method of claim 1, wherein the mold has a density between 1.77 and 1.9 grams/cc and compressive strength between 17,000 psi and 35,000.

8. The method of claim 1, wherein the mold has been vibrationally molded.

9. The method of claim 1, where the mold is rotated along its own axis either horizontally or vertically or at an inclined angle under vacuum or under partial pressure of inert gas while the molten alloy is being poured into the mold.

10. The method of claim 1, wherein a cavity is machined into the inside surface of the cylindrical mold that will allow fabrication of casting with contoured profile on the outside diameter.

11. A centrifugal casting apparatus for casting metal products comprising, an isotropic graphite mold, and means for rotating the isotropic graphite mold.

12. The apparatus according to claim 11, wherein the isotropic graphite mold comprises at least two isotropic graphite portions which are releasably attached to each other such that a metal product cooled within the mold can be removed from the mold.

* * * * *